United States Patent [19]

Yoshida et al.

[11] Patent Number: 4,535,589

[45] Date of Patent: Aug. 20, 1985

[54] EXHAUST GAS CLEANING DEVICE FOR INTERNAL COMBUSTION ENGINE

[75] Inventors: Hitoshi Yoshida, Kariya; Masahiro Tomita; Shigeru Takagi, both of Anjo, all of Japan

[73] Assignee: Nippon Soken, Inc., Nishio, Japan

[21] Appl. No.: 620,543

[22] Filed: Jun. 13, 1984

Related U.S. Application Data

[62] Division of Ser. No. 381,887, May 25, 1982, abandoned.

[30] Foreign Application Priority Data

May 26, 1981 [JP] Japan ..... 56-79841
Jun. 9, 1981 [JP] Japan ..... 56-88483

[51] Int. Cl.[3] ..... F01N 3/02

[52] U.S. Cl. ..... 60/303; 55/282; 55/283; 55/466; 55/DIG. 10; 55/DIG. 30; 60/311; 219/375; 219/553

[58] Field of Search ..... 60/303, 300, 311; 55/DIG. 10, DIG. 30, 282, 283, 466; 219/375, 374, 553

[56] References Cited

U.S. PATENT DOCUMENTS 1,789,812 1/1931 Frazer ..... 60/300
2,731,713 1/1956 Schaeffer ..... 219/375
3,163,841 12/1964 Willett ..... 219/375
3,691,346 9/1972 Dyre ..... 219/375
4,211,075 7/1980 Ludecke ..... 60/303

FOREIGN PATENT DOCUMENTS 684284 3/1965 Italy ..... 219/375
2524 1/1979 Japan ..... 219/375

*Primary Examiner*—Douglas Hart
*Attorney, Agent, or Firm*—Cushman, Darby & Cushman

[57] ABSTRACT

An exhaust gas cleaning device provided with a filter member for collecting particulates in the exhaust gases, and an electric heater for burning and eliminating the particulates collected by the filter member, is disclosed. The filter member is formed of electrically insulating ceramic and is installed in the exhaust gas passage. The heater is formed of ceramic provided with a large number of open passages and having electric conductivity or electrically insulating property. The heater is closely adhered to the exhaust gas inlet end surface of the filter member. In the case that the electrically conductive ceramic is used, the ceramic itself acts as a heating element which heats and ignites the collected particulates. In the case that the electrically insulating ceramic is used, a metallic film acting as a heating element is formed on the walls of the ceramic defining the open passages by printing, vacuum evaporating or other method.

15 Claims, 17 Drawing Figures

EXHAUST GAS CLEANING DEVICE FOR INTERNAL COMBUSTION ENGINE

This is a division of application Ser. No. 381,887, filed May 25, 1982, abandoned upon the filing hereof.

BACKGROUND OF THE INVENTION

The present invention relates to an exhaust gas cleaning device for an internal combustion engine, more particularly, to an exhaust gas cleaning device provided with a filter member which collects particulates in the exhaust gases an an electrically heating means which heats and burns the particulates collected by the filter member.

Since the fuel consumption of diesel engines is small, they have been recently employed as engines for vehicles.

However, diesel engines discharge a large amount of carbon particulates, that is smoke as compared with gasoline engines. Therefore, such an exhaust gas cleaning device as to decrease the amount of the smoke, has been required in the diesel engines.

Conventionally, an exhaust gas cleaning device provided with a filter member for collecting carbon particulates in the exhaust gases and an electric heater for raising the temperature of the exhaust gases entering the filter member and burning the particulates collected by the filter member has been proposed.

For example, U.S. Pat. No. 4,211,075 discloses the device provided with a grid-shaped electric heater which is disposed in the exhaust gas passage on the upper stream side of the filter member at a distance therefrom.

However, according to this divice, the heater firstly heats the exhaust gases and then the heated exhaust gases heat the filter member and the particulates collected by the filter member so that heat applied to the heater is liable to be loosen due to radiation loss. And according to this device, the whole amount of exhaust gases is heated so that a larger amount of electric power is required for heating the exhaust gases to a combustion temperature of the particulates.

And another device provided with a plurality of heaters which are disposed on the inlet end surface of the filter member or adjacent thereto, has been also proposed.

However, according to this device, a leading wire for each heater is liable to contact with another one and the structure for retaining a plurality of heaters and for disposing the leading wires thereof is complex. Furthermore, when the flow quantity of the exhaust gases is large, heat of the heater is not effectively transmitted to the particulates collected by the filter member.

Accordingly, one object of the present invention is to provide an exhaust gas cleaning device for an internal combustion engine, comprising an electric heater which can effectively burn and eliminate the carbon particulates collected by the filter member by a small amount of electric power consumption.

Another object of the present invention is to provide an exhaust gas cleaning device for an internal combustion engine, comprising an electric heater which is stably attached by a simple attaching structure.

DESCRIPTION OF THE DRAWINGS

Other objects and advantages of the invention will become apparent from the following description of embodiments thereof with reference to the accompanying drawings wherein:

FIG. 2 is a partially sectional view of the first embodiment;

FIG. 3 is a partially cut away end view of the first embodiment;

FIG. 5 is a sectional view of an electric heater taken in the radial direction thereof;

FIG. 6 is a sectional view taken along the line VI—VI of FIG. 5;

FIG. 7 is an exploded view illustrating the structure of the electric heater;

FIG. 8 is a sectional view of the electric heater;

FIG. 9 is a sectional view taken along the line IX—IX of FIG. 8;

FIG. 10 is a sectional view of a porous body provided with a heat generator;

FIG. 11 is a sectional view taken along the line XI—XI of FIG. 10;

FIG. 12 is a sectional view of a modification of the porous body of the fifth emboidment;

SUMMARY OF THE INVENTION

The exhaust gas cleaning device of the present invention comprises a filter member for collecting particulates in the exhaust gases, and an electric heater for burning and eliminating the particulates collected by the filter member. The filter member is formed of electrically insulating ceramic and is installed in the exhaust gas passage. The heater is formed of ceramic provided with a large number of open passages and having electric conductivity or electrically insulating property. The heater is closely adhered to the exhaust gas inlet end surface of the filter member.

The heater is provided with at least one heating element which is partially and integrally formed therein. The heating element is arranged about the axis of the heater uniformly.

DETAILED DESCRIPTION OF THE INVENTION

Hereinafter, the present invention will be explained in accordance with the embodiments with reference to the accompanying drawings.

Figure 1:
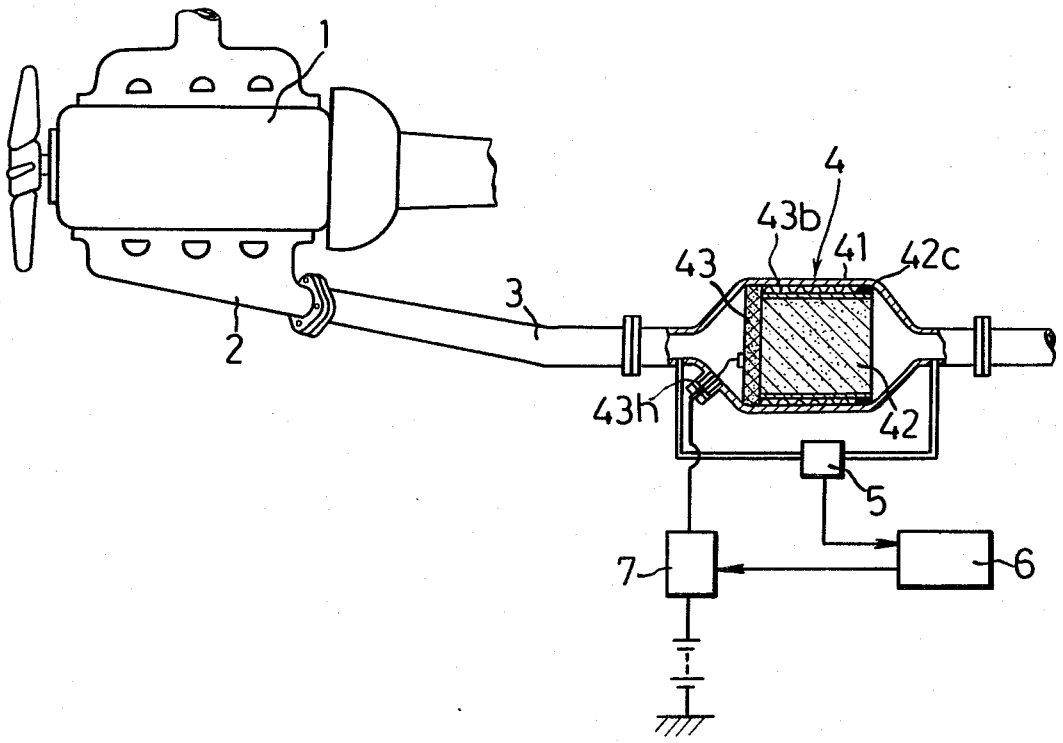
FIG. 1 is a diagram showing an exhaust system of an internal combustion engine in which the exhaust gas cleaning device of the present invention is installed.

In FIG. 1, the reference numeral 1 designates an internal combustion engine, the reference numeral 2 designates an exhaust manifold, the reference numeral 3 designates an exhaust pipe, and the reference numeral 4 designates an exhaust gas cleaning device which is disposed in the exhaust pipe 3.

The device 4 is provided with a casing 41, a filter member 42 accomodated within the casing 41 and an electric heater 43 which is formed of a porous body and is positioned adjacent to the exhaust gas inlet end surface of the filter member 42.

The device 4 is further provided with a differential pressure sensor 5 for detecting the differential pressure between the exhaust gas inlet side and the exhaust gas outlet side of the filter member 42. The sensor 5 is connected to a relay 7 through a control device 6.

The electric heater 43 is connected to a battery 8 through the relay 7.

While the exhaust gases pass through the electric heater 43 and the filter member 42, particulates in the exhaust gases are collected thereby.

As the particulates collecting operation proceeds, the flowing resistance of the electric heater 43 and the filter member 42 gradually increases so that the differential pressure between the exhaust gas inlet side and the exhaust gas outlet side of the filter member 42 gradually increases.

When the differential pressure reaches a predetermined pressure, the differential pressure sensor 5 detects this timing and the control device 6 supplies an electric signal to the relay 7. As a result, an electric current is supplied to the electric heater 43 from the battery 8. And the electric heater 43 generates heat so that the particulates collected by the electric heater 43 are heated to start burning.

The combustion heat is transmitted to the particulates collected by the filter member 42 to burn and eliminate all collected particulates.

Hereinafter, the exhaust gas cleaning device 4 of the present invention will be explained in detail.

Figure 2:
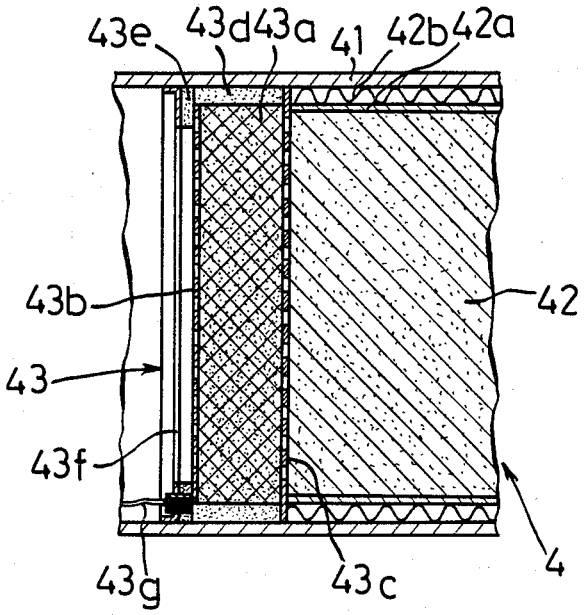
FIGS. 2 and 3 are views illustrating a first embodiment of the exhaust gas cleaning device according to the present invention.
Figure 3:
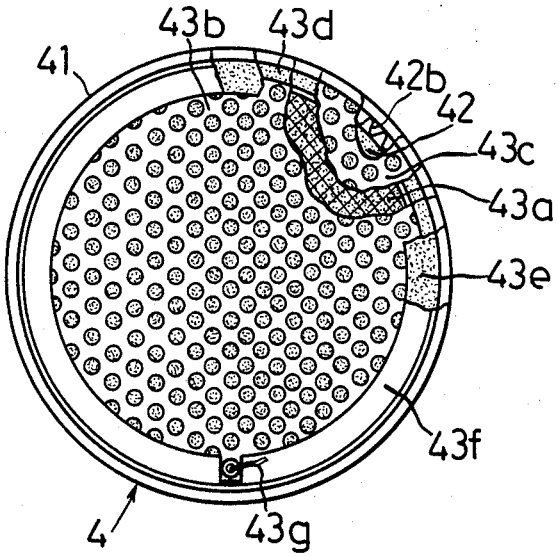

FIGS. 2 and 3 illustrate a first embodiment of the cleaning device according to the present invention.

Within a cylindrical metallic casing 41, a filter member 42 is accomodated. The filter member 42 is formed of a cordierite ceramic porous body provided with interconnected narrow pores.

Around the filter member 42, a reinforcing wall **42*a* is integrally formed therewith. The reinforcing wall 42*a* is elastically supported within the casing 41 through a shock absorbing member 42*b*** formed of wire net.

Between the filter member 42 and the casing 41, an annular sealing member **42*c* is provided as shown in FIG. 1**.

The electric heater 43 is provided with a porous body **43*a* formed of such ceramic as to generate heat upon receiving an electric current, a positive electrode plate 43*b* and a negative electrode plate 43*c* which are closely adhered to both end surfaces of the porous body 43*a***.

The ceramic for forming the porous body **43*a***, is silicon carbide, lanthanum chromite or the like.

The porous body **43*a*** also acts as a filter for collecting particulates in the exhaust gases.

The negative electrode plate **43*c* is closely adhered to the end surface of the filter member 42 on the exhaust gas inlet side and the outer periphery thereof is welded to the inner peripheral surface of the casing 41**.

The end surface of the porous body **43*a* on the exhaust gas outlet side, is closely adhered to the negative electrode plate 43*c*. And to the end surface of the porous body 43*a* on the exhaust gas inlet side, the positive electrode plate 43*b* having a diameter equal to that of the porous body 43*a***, is closely adhered.

Between the outer peripheral surface of the porous body **43*a* and the positive electrode 43*b*, and the inner peripheral surface of the casing 41, an insulating member 43*d*** formed of asbestos is interposed.

And a ring-shaped insulating member **43*a* is closely contacted with the end surface of the positive electrode 43*b***.

The whole electric heater 43 is pressed to the end surface of the filter member 42 by a ring stay **43*f* which is welded to the inner peripheral surface of the casing 41 through the insulating member 43*e***.

The electrode plates **43*b*, 43*c* are formed of a punched metal plate provided with a larger number of through holes and having a sufficiently excellent air-permeability as compared with the filter member 42**.

In the end portion of the positive electrode plate **43*b*, a positive electrode terminal 43*g* is formed and is connected to the battery 8 through the relay 7 while being insulated from the casing 41 by means of a nipple 43*h***.

In operation, while the exhaust gases pass through the porous body **43*a* of the electric heater 43 and the filter member 42**, the particulates in the exhaust gases are collected thereby.

When the amount of collected particulates reaches a predetermined amount, an electric current is supplied to the porous body **43*a*** to generate heat.

The particulates collected by the porous body **43*a* are directly heated to burn. This burning spreads to the particulates collected by the filter member 42** positioned on the exhaust gas outlet side so that the all collected particulates are burnt and eliminated.

As described above, according to the first embodiment, since the electric heater 43 is formed of a porous body and is positioned in contact with the filter member 42, heat loss due to radiation loss can be decreased. And since the electric heater directly heats the particulates collected by the heater, the heating efficiency is very high so that the collected particulates can be effectively burnt and eliminated by a small amount of electric power consumption.

Furthermore, by employing the ceramic porous body **43*a* as a heating element and fixing it to the end surface of the filter member 42, the heater 43 can be simply and easily assembled and can be stably installed within the casing 41**.

Figure 4:
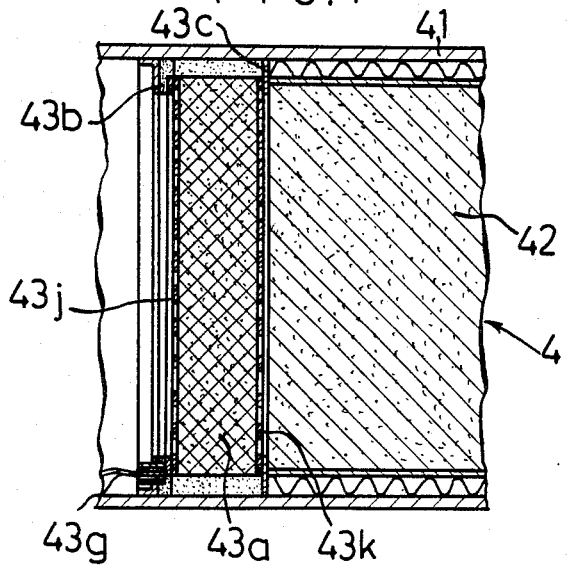
FIG. 4 is a partially sectional view of a second embodiment of the cleaning device according to the present invention.

FIG. 4 illustrates a second embodiment of the cleaning device according to the present invention.

In both end surfaces of the ceramic porous body **43*a*, thin films 43*j*, 43*k* of electrically conductive and heat resistant metal such as platinum, palladium, nickel-chrome alloy, iron-chrome alloy, etc. are formed, respectively. And the electrode plates 43*b*, 43*c* which contact with the thin films 43*j*, 43*k*** are formed into an annular shape, respectively.

The electrically conductive films **43*j*, 43*k* have an effect of reducing contact resistance between the porous body 43*a* and the electrode plates 43*b*, 43*c*** and are easily formed on both end surfaces of the porous body 43*a* by printing and firing metallic paste thereon, for example.

In the first and the second embodiments, the bulk density of the inlet end portion of the filter member 42 which contacts with the electric heater 43, can be partially made larger than that of the other portion thereof. To the portion of which bulk density is larger, a large amount of particulates are adhered so that the particulates collected by the filter member 42 can be easily ignited.

Figure 5:
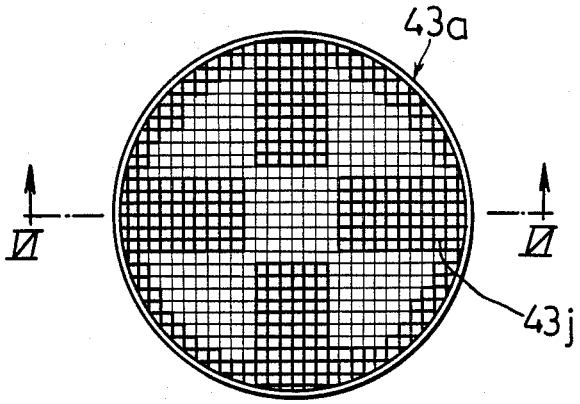
FIGS. 5 to 7 are views illustrating an electric heater used in a third embodiment of the exhaust gas cleaning device according to the present invention.
Figure 6:
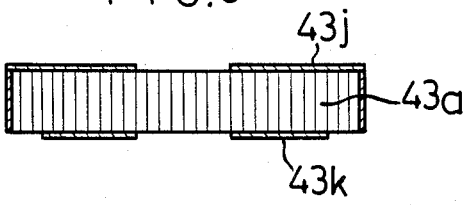
Figure 7:
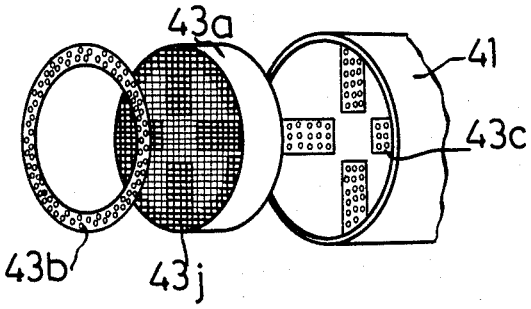

FIGS. 5, 6 and 7 illustrate a third embodiment of the electric heater of the cleaning device according to the present invention.

In the third embodiment, the porous body 43*a* is composed of a silicon carbide honeycomb structure provided with a larger number of grid-shaped open passages.

The annular outer peripheral portion of the inlet end surface of the porous body 43*a*, and four rectangular portions extending from the annular outer peripheral portion towards the center thereof, electric conductive films 43*j* are formed. And to the annular outer peripheral portion of the film 43*j*, an annular positive electrode plate 43*b* formed of a punched metal plate is closely adhered.

In the outlet end surface of the porous body 43*a* four rectangular electric conductive films 43*k* are formed so as to be opposed to the rectangular portions of the inlet end surface thereof.

To the inner peripheral surface of the casing 41 one end of each of four pieces of rectangular negative electrode plates 43*c* is welded.

And within the casing 41, the filter member (not shown) is accomodated on the downstream side of the negative electrode plates 43*c*.

The porous body 43*a* is accomodated within the casing 41 so that the electrically conductive films 43*k* formed on the outlet end surface thereof, contact with the negative electrode plates 43*c*. To the electrically conductive films 43*j* formed on the inlet end surface of the porous body 43*a*, the positive electrode plate 43*b* is closely adhered. Thus, the electric heater is fixed within the casing 41.

According to the third embodiment, the porous body 43*a* is locally heated and the particular collected in the heated portions are burnt off.

When the particulates are locally burnt, the particulates collected in the portions adjacent to the heated portions are also burnt due to the combustion heat and then the particulates collected by the filter member 42 are also burnt off.

Figure 8:
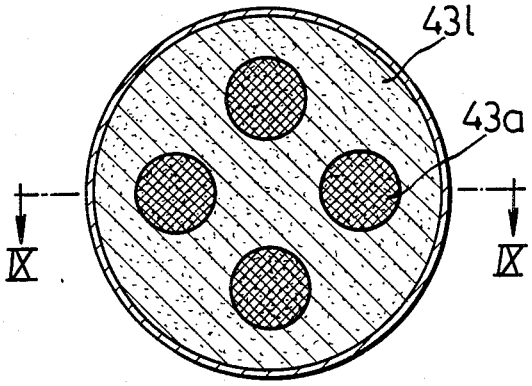
FIGS. 8 and 9 are views illustrating an electric heater used in a fourth embodiment of the exhaust gas cleaning device according to the present invention.
Figure 9:
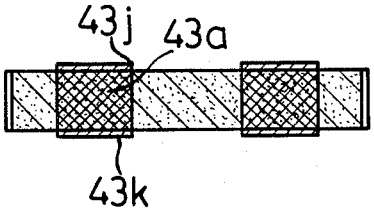

FIGS. 8 and 9 illustrate a fourth embodiment of the cleaning device according to the present invention. In the fourth embodiment, four pieces of columnar silicon carbide porous bodies 43*a* having electric conductivity are buried within the cordierite ceramic foamed porous body 43*l* having electrically insulating property. And both end surfaces of the bodies 43*a* are covered with electrically conductive films 43*j*, 43*k*, respectively.

And the porous body 43*l* having the above structure is fixed within the casing so that the positive electrode plate contacts with the films 43*j* and the negative electrode plate contacts with the films 43*k*.

When an electric current is suppied to the porous bodies 43*a*, they generate heat to burn the particulates collected by the porous bodies 43*a*. The combustion of the particulates spread into the porous body 43*l* adjacent to the porous bodies 43*a* and furthermore into the filter member 42.

Figure 10:
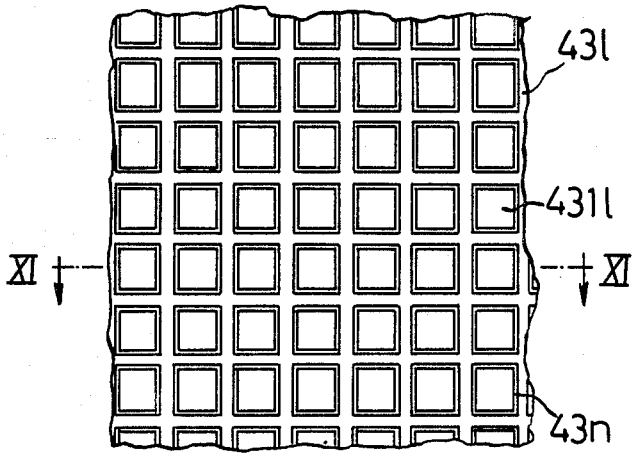
FIGS. 10 to 12 are views illustrating a fifth embodiment of the exhaust gas cleaning device according to the present invention.
Figure 11:
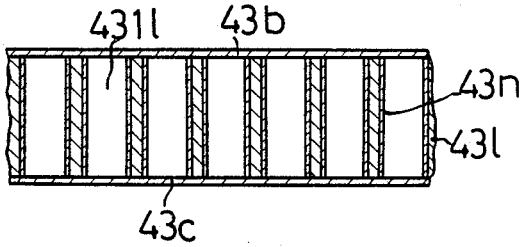
Figure 12:
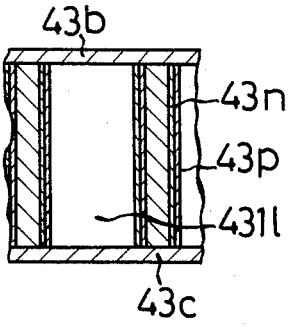
Figure 13:
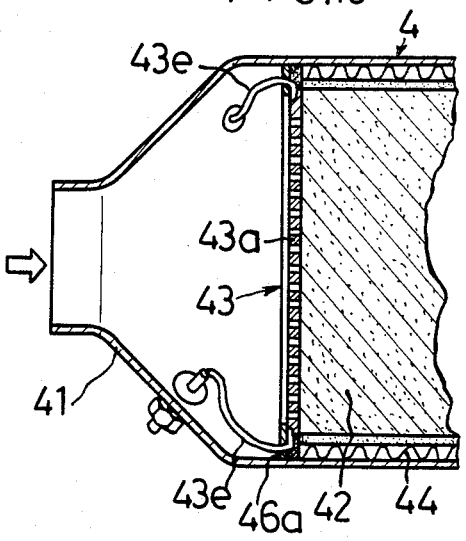
FIG. 13 is a sectional view of a sixth embodiment of the exhaust gas cleaning device according to the present invention.
Figure 14:
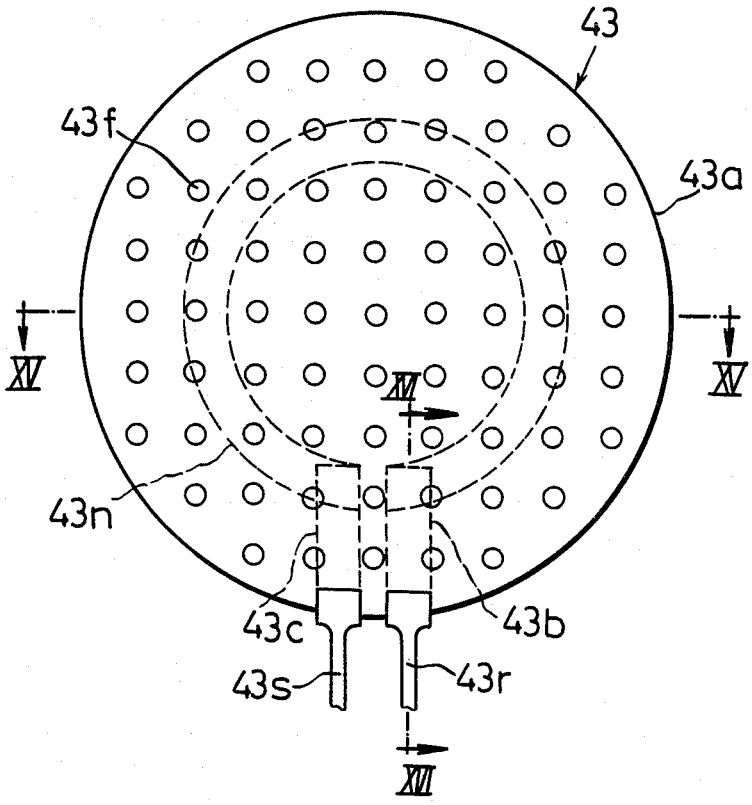
FIG. 14 is a plan view of the electric heater of the sixth embodiment.
Figure 15:
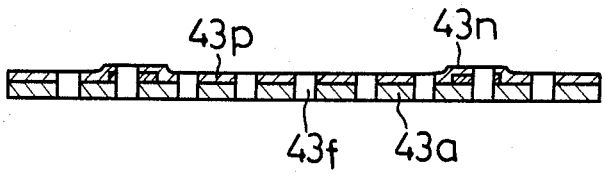
FIG. 15 is a sectional view taken along the line XV—XV of FIG. 14.
Figure 16:
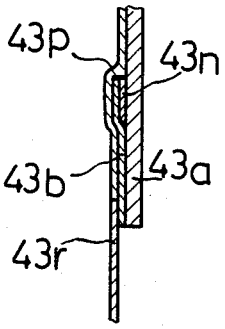
FIG. 16 is a sectional view taken along the line XVI—XVI of FIG. 14.

FIGS. 10 to 12 illustrate a fifth embodiment of the cleaning device according to the present invention.

In the fifth embodiment, a cordierite ceramic honeycomb structure is employed as the porous body 43*l* which is disposed in contact with the inlet end surface of the filter member (not shown).

As shown in FIGS. 11 and 12, on the grid-shaped inner surfaces defining open passages 431*l*, platinum films 43*n* having a thickness as small as about 5 to 20μ are formed. And the both end surfaces of the porous body 43*l* are covered with a metallic layers which is thicker than the films 43*n* to form the positive electrode plate 43*b*, and the negative electrode plate 43*c*.

The films 43*n* and the electrode plates 43*b*, 43*c* are formed by immersing the porous body 43*l* within a bath of platinum paste solution having a sufficiently low viscosity and taking the body 43*l* out of the bath. After being dried, to the both end surfaces of the porous body 43*l*, platinum is screen printed, dried and fired.

As a result, in the wall surfaces defining the open passages, thin films 43*n* are formed while in both end surfaces of the porous body 43*l*, electrodes plates 43*b*, 43*c*, which are thicker than the films 43*n*, are formed.

Since the films 43*n* are very thin, it acts as a resistor to generate heat upon receiving an electric current.

According to the fifth embodiment, while the exhaust gases pass through the open passages 431*l* of the porous body 43*l* provided with the resistance heating films 43*n*, one part of the particulates in the exhaust gases are collected by the open passages of the porous body and the collected particulates are heated by the films 43*n* to burn. And the combustion of the collected particulates spreads to the filter member positioned on the downstream side of the porous body 43*l*.

Furthermore, as shown in FIG. 12, a very thin electrically insulating films 43*p* of cordierite ceramic may be formed on the films 43*n* by coating.

By forming the films 43*p*, the films 43*n* can be prevented from being corroded due to exhaust gases without any serious lowering of the particulates heating efficiency of the films 43*n*.

The resistance-heating films 43*n* may be formed of other material than platinum. For example, palladium, gold, iron-chromium alloy, nickel-chromium alloy, silicon carbide, lanthanum chromite or the like, will do. The resistance-heating films 43*n* may be formed by other method such as vacuum evaporating method in place of coating method.

FIGS. 13 to 17 illustrate a sixth embodiment of the cleaning device according to the present invention.

In the sixth embodiment, a filter member 42 is accomodated within the casing 31. Between the outer peripheral surface of the filter member 42 and the inner peripheral surface of the casing 41, a shock absorbing member 42*b* and the sealing member 42*c* (FIG. 1) are interposed. To the inlet end surface of the filter member 42, a porous plate 43*a* of an electric heater 43 is closely adhered. And the filter member 42 and the porous plate 43*a* are fixed by a ring stay 46*a* which is provided in the casing 41 so as to contact with the inlet end surface of the porous plate 43*a*.

The porous plate 43*a* is formed of electrically insulating material such as alumina, and a heating element 43*n* is formed on the porous plate 43*a* like a loop by vacuum evaporating method or printing method. And electrodes 43*b*, 43*c* are also formed by vacuum evaporating method or printing method so as to connect to both ends of the loop-shaped heating element 43*n*, respectively.

Then, in the whole surface of the porous plate 43*a*, an electrically insulating film 43*p* is formed by printing so as to cover the heating element 43*n* and the electrodes 43*b*, 43*c*.

The electric heater 43 having the above structure is disposed so that the electrically insulating film 43*p* is closely adhered to the inlet end surface of the filter member 42.

One end of each of lead wires 43*r*, 43*s* is connected to each of the electrodes 43*b*, 43*c* while the other end of one of the lead wires 43*r*, 43*s* is earthed and the other end of the other lead wire is connected to a battery 8.

In the whole surface of the porous body 43*a*, a large number of open passage 43*f* are formed so as to have air-permeability higher than that of the filter member 42.

The width of the heating element 43*n* is made smaller than that of the electrodes 43*b*, 43*c* while the length of the heating element 43*n* is made larger than that of the electrodes 43*b*, 43*c*.

The electrically insulating film 43*p* can be omitted but it is preferable to form the film 43*p* on the porous plate 43*a* in order to increase durability of the heater 43. And it is preferable to form the film 43*p* thin in order to transmit the heat of the heating element 43*n* into the filter member 42 efficiently.

Figure 17:
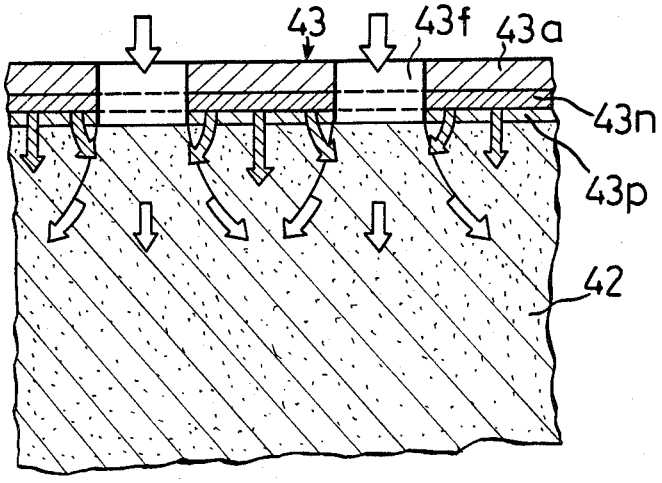
FIG. 17 is a view showing the operation of the cleaning device of the sixth embodiment.

In the exhaust gas cleaning device having the above described construction, the exhaust gases flow into the filter member 42 through the holes 43*f* of the electric heater 43 as shown by white arrows in FIG. 17 and the particulates in the exhaust gases are collected by the electric heater 43 and the filter member 42.

When the amount of particulates collected by the filter member 42 reaches a predetermined amount, an electric current flows into the heating element 43*n* to generate heat. Since the heating element 43*n* is covered by the porous plate 43*a*, heat generated by the heating element 43*n* is not transmitted to the exhaust gases entering the filter member 42. Heat of the heating element 43*n* is mainly transmitted through the film 43*p* to the upper portion of the filter member 42 below the film 43*p*, wherein the exhaust gases stagnate without flowing downwardly.

Therefore, such a portion of the filter member 42 and the exhaust gases stagnating therein are mainly heated by the heating element 43*n* so that the particulates collected therein are firstly burnt to generate combustion heat. And it is transmitted to the whole filter member 42 to burn the particulates collected therein.

As described above, according to the exhaust gas cleaning device of the present invention, the electric heater is integrally formed with the porous ceramic body which is firmly fixed to the end surface of the filter member so that the heater can be stably retained and also can be attached to the filter member.

Furthermore, since the heater directly heats the particulates collected by itself and in the end surface of the filter member, the particulates can be heated efficiently and also can be ignited by a small amount of electric power consumption as compared with the conventional heater.

Having now fully described the invention, it will be apparent to oneof ordinary skill in the art that many changes and modifications can be made thereto without departing from the spirit or scope of the invnetion as set forth herein.

What is claimed is:

1. An exhaust gas cleaning device for collecting particulates in exhaust gases of an internal combustion engine and burning the collected particulates, comprising:

a filter member which is disposed in an exhaust gas passage of said internal combustion engine for collecting the particulates in the exhaust gases, said filter member being formed of ceramic and provided with a large number of interconnected passages for passing the exhaust gases therethrough;

an electrical heating means composed of a ceramic base body having at least one heating element which is partially and integrally formed in said base body, said heating element being arranged about the axis of said ceramic base body uniformly;

said ceramic base body being provided with opposed end surfaces and a large number of passages for passing the exhaust gases therethrough and one of said opposed end surfaces of said base body being closely adhered to an exhaust gas inlet end surface of said filter member; and an electric power supplying means for electrically connecting said heating element to an electric power source.

2. An exhaust gas cleaning device according to claim 1, wherein:

said filter member and said ceramic base body have a circular cross section, respectively; and the diameter of said ceramic base body is substantially equal to that of said filter member;

said ceramic base body covers the whole inlet end surface of said filter member; and the thickness of said ceramic base body in the exhaust gas flowing direction is smaller than that of said filter member.

3. An exhaust gas cleaning device according to claim 1, wherein:

said ceramic base body is composed of a honeycomb structure provided with a large number of parallel open passages defined by thin partition walls.

4. An exhaust gas cleaning device according to claim 1, wherein said ceramic base body is formed of a porous ceramic body provided with a large number of passages.

5. An exhaust gas cleaning device according to claim 2, wherein said electric power supplying means comprises a positive electrode and a negative electrode which are closely adhered to said heating element.

6. An exhaust gas cleaning device according to claim 5, wherein:

said ceramic base body is formed of electrically conductive ceramic.

7. An exhaust gas cleaning device according to claim 5, wherein:

said ceramic base body has electrically insulating property.

8. An exhaust gas cleaning device according to claim 6, wherein:

said electrically conductive ceramic is silicon carbide or lanthanum chromite.

9. An exhaust gas cleaning device according to claim 6, wherein said heating element is composed of two electrically conductive metallic films which are formed on said opposed end surfaces of said base body so as to be opposed to each other; and said positive electrode is closely adhered to one of said electrically conductive films while said negative electrode is closely adhered to the other electrically conductive film.

10. An exhaust gas cleaning device according to claim 7, wherein:

said ceramic base body is formed of a thin plate having a plurality of through holes;

said heating element is a loop-shaped metallic film which is integrally formed on the exhaust gas outlet and surface of said ceramic base body;

said metallic film is provided with two ends which are opposed to each other at a predetermined distance;

said positive electrode and said negative electrode are connected to said two ends of said metallic film, respectively; and said metallic film and said electrodes are covered by heat conductive ceramic film.

11. An exhaust gas cleaning device according to claim 7, wherein:

said electrically insulating ceramic is cordierite or alumina.

12. An exhaust gas cleaning device according to claim 7, wherein said heating element is composed of an electrically conductive ceramic body provided with a large number of passages, which is buried within said ceramic base body so as to extend therethrough; and said positive electrode is closely adhered to one end surface of said electrically conductive porous ceramic body while said negative electrode is closely adhered to the other end surface thereof.

13. An exhaust gas cleaning device according to claim 12, wherein an electrically conductive metallic film is interposed between each of said electrodes and each of end surfaces of said electrically conductive porous ceramic body.

14. An exhaust gas cleaning device according to claim 10, 9 or 13 wherein:

said metallic film is formed of platinum, palladium, nickel-chromium alloy, iron-chromium alloy, gold or lanthanum chromite.

15. An exhaust gas cleaning device according to claim 10, 9 or 13, wherein:

said metallic film is formed on said ceramic base body by printing or vacuum evaporating.

* * * * *